US010781647B2

(12) United States Patent
Copold

(10) Patent No.: US 10,781,647 B2
(45) Date of Patent: Sep. 22, 2020

(54) DOWNHOLE ROLLER

(71) Applicant: Schlumberger Technology Corporation, Sugar Land, TX (US)

(72) Inventor: Derek Copold, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 364 days.

(21) Appl. No.: 14/849,149

(22) Filed: Sep. 9, 2015

(65) Prior Publication Data

US 2017/0067299 A1 Mar. 9, 2017

(51) Int. Cl.
*E21B 17/10* (2006.01)

(52) U.S. Cl.
CPC ..... *E21B 17/1057* (2013.01)

(58) Field of Classification Search
CPC ..... E21B 17/1057
See application file for complete search history.

(56) References Cited

U.S. PATENT DOCUMENTS 4,861,075 A * 8/1989 Pepi ..... F16L 17/04 24/279
5,692,563 A 12/1997 Krueger et al.
6,688,409 B1 2/2004 Murray
6,779,598 B2 8/2004 Hall
7,395,881 B2 7/2008 McKay et al.
7,866,384 B2 1/2011 Hall
8,011,429 B2 9/2011 McNay
8,733,455 B2 5/2014 Shaikh et al.
2008/0169107 A1* 7/2008 Redlinger ..... E21B 17/1014 166/382
2012/0255744 A1* 10/2012 Shaikh ..... E21B 17/1057 166/380
2013/0248208 A1* 9/2013 Copold ..... E21B 17/1057 166/385
2015/0308207 A1* 10/2015 Mccormick ..... E21B 23/14 104/138.2
2017/0050687 A1* 2/2017 Kaufmann ..... B62D 55/088
2018/0119498 A1* 5/2018 Christie ..... E21B 23/14

FOREIGN PATENT DOCUMENTS

WO WO-2016170356 A1 * 10/2016 ..... E21B 23/14

* cited by examiner

*Primary Examiner* — George S Gray
(74) *Attorney, Agent, or Firm* — Eileen Pape

(57) ABSTRACT

A downhole roller having a body. The downhole roller also has a wheel connected with the body, and a bearing assembly disposed between the body and the wheel to allow the wheel to move relative to the body. The downhole roller can also have an internal shaft between the wheel and the bearing assembly, wherein the internal shaft holds the bearing assembly in place.

15 Claims, 4 Drawing Sheets

DOWNHOLE ROLLER

BACKGROUND

During the conveyance of wireline tools, the toolstring is often subjected to friction. To make conveyance of wireline tools more efficient and reduce the risk of sticking during conveyance, rollers are often used with the toolstring. The rollers are often retained using external mechanism; however, these mechanisms are hard to maintain and take up significant space.

SUMMARY

An example downhole roller includes a body. The body has a wheel connected therewith. A bearing assembly is disposed between the body and the wheel to allow the wheel to move relative to the body. An internal shaft is located between the wheel and the bearing assembly. The internal shaft holds the bearing assembly in place.

An example method of conveying a tool into a wellbore includes connecting a toolstring with a downhole roller. The downhole roller includes a body with a wheel connected therewith. A bearing assembly is disposed between the body and the wheel to allow the wheel to move relative to the body. The downhole roller also includes an internal shaft between the wheel and the bearing assembly, and the internal shaft holds the bearing assembly in place. The method also includes running the toolstring and downhole roller into the wellbore.

An example system for conveying a tool into a wellbore includes a downhole roller. The downhole roller includes a body with a wheel connected therewith. A bearing assembly is disposed between the body and the wheel to allow the wheel to move relative to the body. The downhole roller also includes an internal shaft between the wheel and the journal assembly, and the internal shaft holds the bearing assembly in place. The example system also includes a toolstring having at least one downhole tool. A conveyance is connected with the toolstring.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
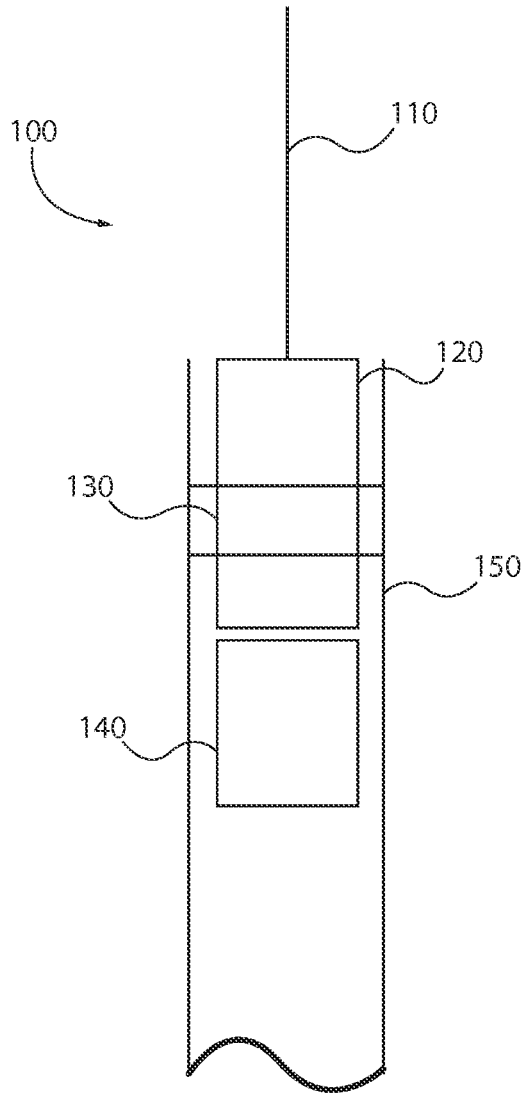
FIG. 1 depicts an example system for conveying a tool into a wellbore.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts an example system for conveying a tool into a wellbore. The system 100 includes a conveyance 110, a toolstring 120, one or more downhole rollers 130, and one or more downhole tools 140. The conveyance 110 can be a slickline, wireline, coil tubing, drill string, or the like.

The toolstring 120 can have one or more segments. The segments can include electronic modules, hydraulic modules, sensors, and communication equipment.

The downhole roller 130 can have one or more wheels connected with a body. The body can be configured to connect about the toolstring 120. The downhole roller 130 can reduce friction between the toolstring 120 and wellbore walls 150 during conveyance. The downhole roller 130 can also mitigate sticking by preventing damage to mud on the side of the wellbore walls 150, thereby preventing differential pressure sticking.

The downhole tool 140 can be a milling tool, a cutting tool, a shifting tool, an anchor, a tractor, a perforating gun, a logging tool, or the like.

Figure 2:
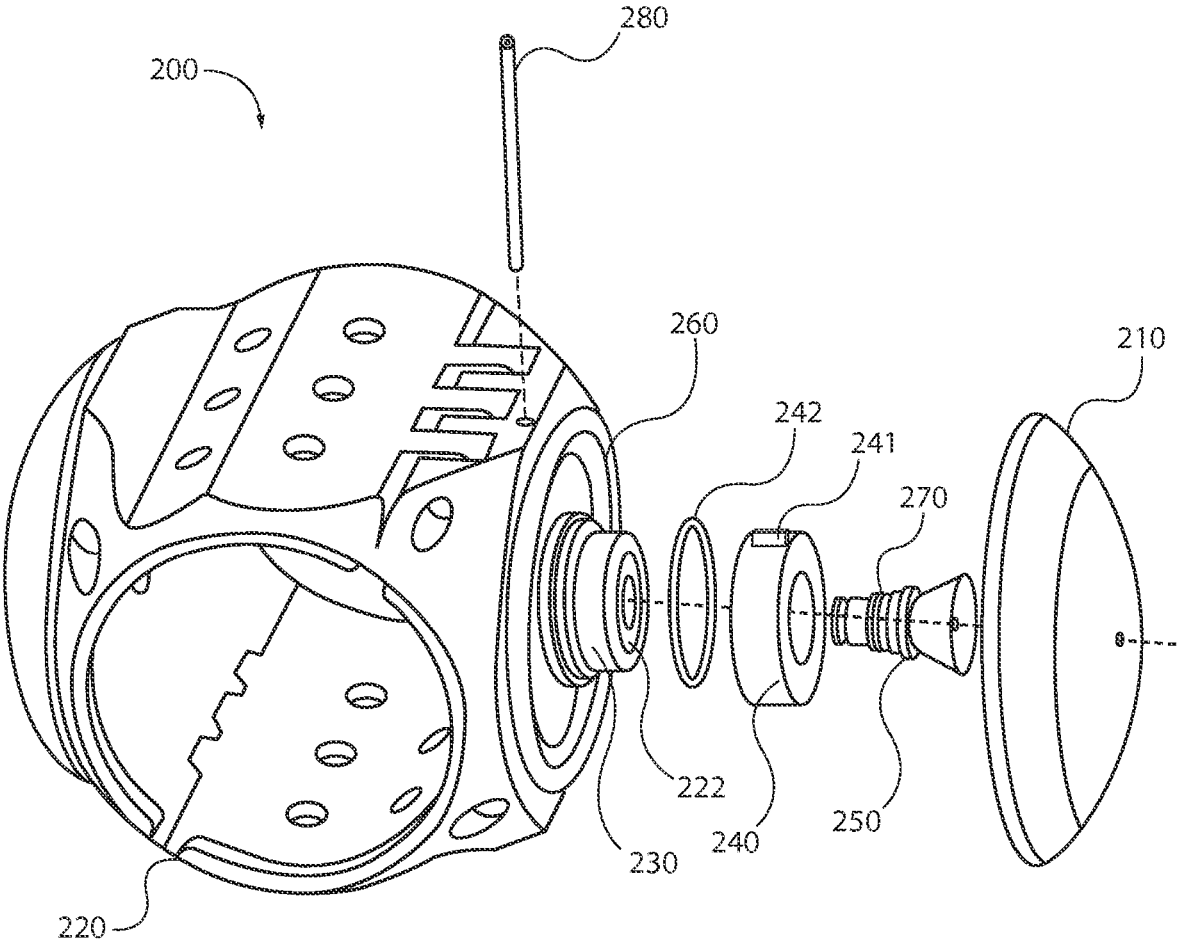
FIG. 2 depicts an example downhole roller.

FIG. 2 depicts an example downhole roller. The downhole roller 200 includes a body 220, one or more wheels 210, one or more internal shafts 250, one or more outer journal bearings 240, one or more retaining rings 242, one or more static seals 270, one or more inner journal bearings 230, one or more rotating seals 260, and one or more locking pins 280.

The body 220 can have a wheel 210 connected on one side thereof and another wheel connected on the other side. Both wheels can be connected to the body in the same way; however, a detail of the wheel connection is only shown for one of the wheels 210.

The wheel 210 can be connected with the body 220 by a bearing assembly that includes an inner journal bearing 230 and an outer journal bearing 240. The inner journal bearing 230 can be placed about a threaded cylinder 222 connected with the body 220. A static seal 270 can be placed about the shaft 250, and the static seal can seal against a land in the threaded cylinder 222. The internal shaft 250 can be threaded to the threaded cylinder 222, holding the journal bearings 230 and 240 in place. The lock pin 280 can be engaged with the internal shaft 250 to prevent the internal shaft from unthreading.

The body 220 can have the rotating seal 260 located thereon. The rotating seal 260 can be on a rotating bearing.

The wheel 210 can be placed about the bearing assembly and a retaining ring 242 can hold the wheel 210 in place. Accordingly, the outer journal bearing 240 can rotate about the inner journal bearing 230, allowing the wheel 210 to rotate relative to the body 220. The key 241 can prevent the outer journal bearing from rotating relative to the wheel 210.

Figure 3:
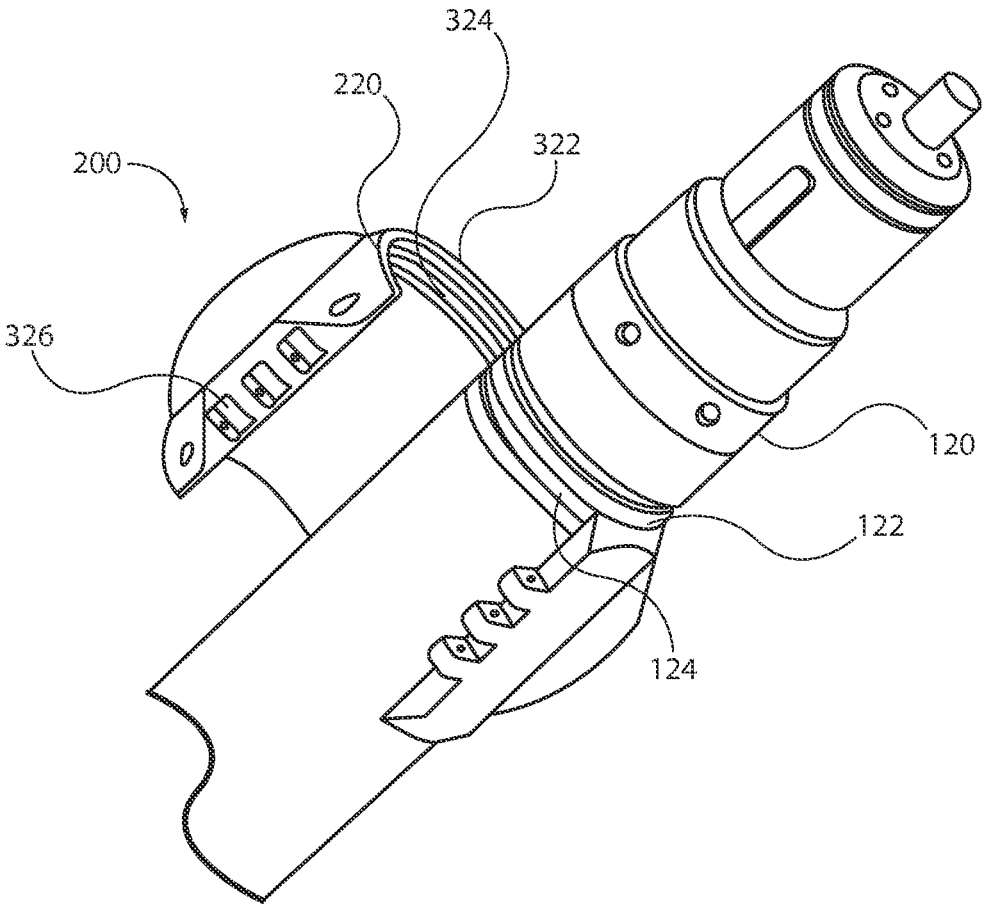
FIG. 3 depicts an example roller having retaining lips formed on a surface thereof.

FIG. 3 depicts an example roller having retaining lips formed on a surface thereof.

The roller 200 can have a body 220. The body 220 has one or more retaining lips 322 and 324 located thereon. The retaining lips 322 and 324 can be formed, connected with, or otherwise located on the body 220. The lips 322 and 324 can be configured to fit in retaining grooves 122 and 124 formed on a toolstring 120. The upper retaining lip 322 can be larger than the retaining lip 324 and act as a point of retention to prevent substantial axial movement of the body 220 relative to the toolstring 120. The lower retaining lip 324 can be smaller and act as a failsafe to prevent incorrect installation onto the toolstring 120. For example, the lower retaining lip 324 can be spaced from the upper lip so that if the roller is installed the wrong direction on the toolstring 120, the lower retaining lip will act as a stop on the toolstring and prevent the pin end 326 from closing, thereby preventing installation of the roller onto the toolstring 120.

A similar method can be used with other accessories, for example a standoff can be formed with retaining lips formed thereon and the toolstring can have similar grooves.

Figure 4:
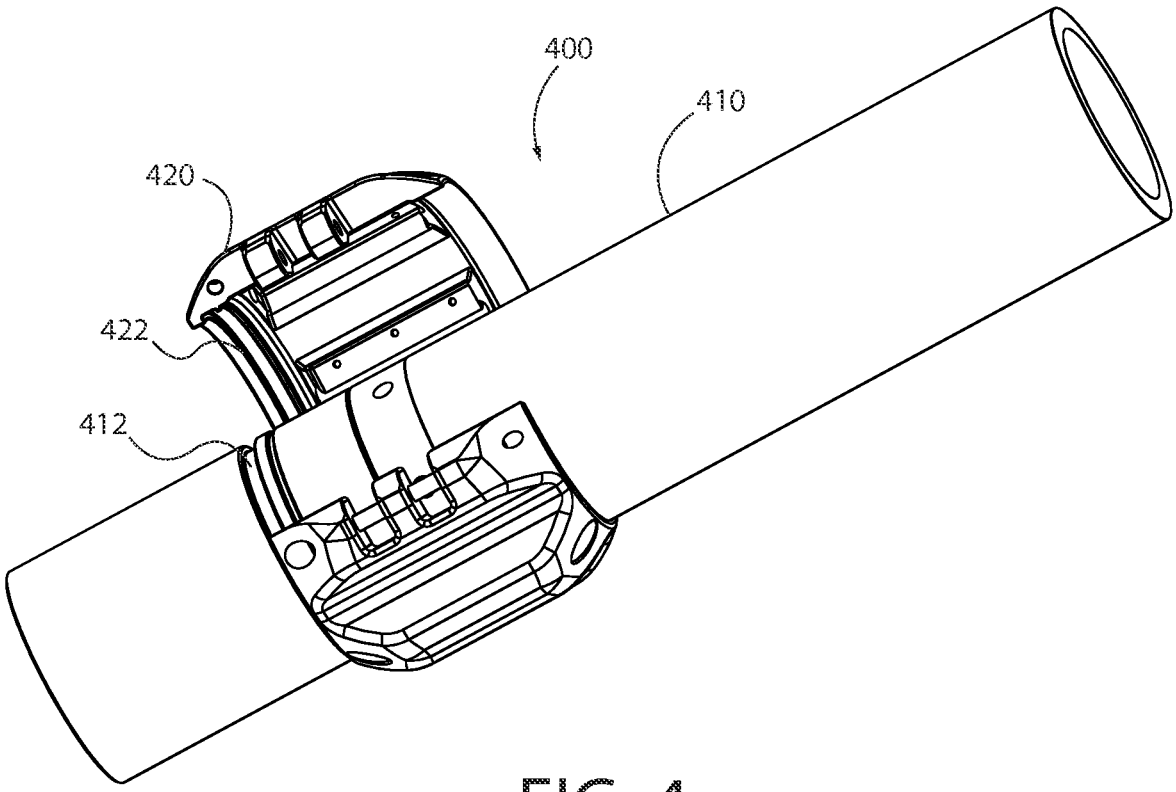
FIG. 4 depicts an example standoff having retaining lips formed on a surface thereof.

FIG. 4 depicts an example standoff having retaining lips formed on a surface thereof. The standoff 400 can include a standoff body 420. The standoff body 420 can have one or more retaining lips 422 formed on an interior thereof. The standoff 400 can be connected about a tubular 410. The tubular 410 can have one or more retaining grooves 412 configured to operatively cooperate with the retaining lips 422 to prevent axial movement of the standoff on the tubular 410.

Figure 5:
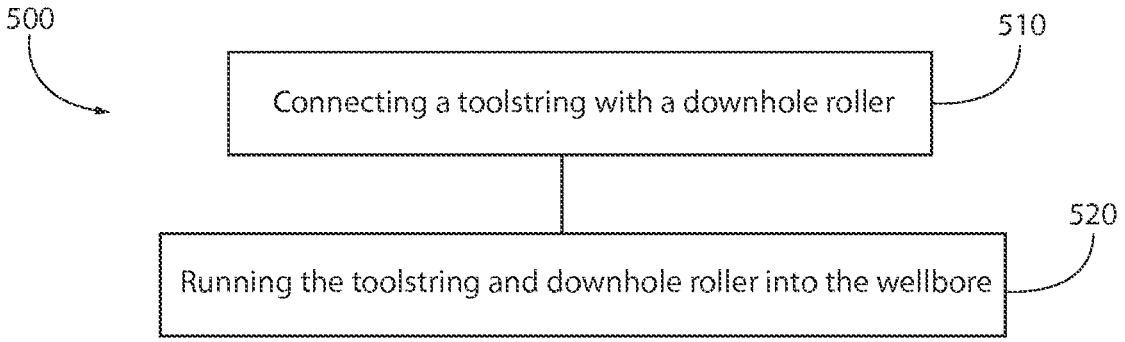
FIG. 5 depicts an example method of conveying a downhole tool.

FIG. 5 depicts an example method of conveying a downhole tool. The method 500 includes connecting a toolstring with a downhole roller, Box 510. The downhole roller can be any roller described herein or substantially similar downhole rollers. The downhole roller can be connected with the toolstring using a hinge pin design. For example, the downhole roller can be hinged at one end and pinned at the other end; the pin can be removed allowing the pinned end to open allowing the downhole roller to be placed about the toolstring, and after being placed about the toolstring, the pinned end can be closed and the pin inserted therein preventing the pin end from opening. The method can also include running the toolstring and downhole roller into the wellbore, Box 520.

The preceding description has been presented with reference to certain embodiments. Persons skilled in the art and technology to which these embodiments pertain will appreciate that alterations and changes in the described structures and methods of operation may be practiced without meaningfully departing from the principle, and scope of these embodiments. For example, while techniques utilized are directed at jacketing a metal core for an oilfield conveyance or line, these techniques may be modified and applied to other hardware such as metallic tool housings. Regardless, the foregoing description should not be read as pertaining only to the precise structures described and shown in the accompanying drawings, but rather should be read as consistent with and as support for the following claims, which are to have their fullest and fairest scope.

I claim:

1. A downhole roller comprising:

a body having a hinged end opposite a closable pinned end, the pin end configured to receive a pin to prevent the pin end from opening, and one or more retaining lips disposed on an inner surface of the body;

a wheel connected with the body;

a bearing assembly disposed between the body and the wheel to allow the wheel to move relative to the body, the bearing assembly including an inner journal bearing and an outer journal bearing;

an internal shaft between the wheel and the bearing assembly and threadably connected to the body, wherein the internal shaft holds the bearing assembly in place; and a lock pin engaged with the internal shaft to prevent the internal shaft from unthreading.

2. The downhole roller of claim 1, wherein the bearing assembly comprises an additional inner journal bearing and an additional outer journal bearing.

3. The downhole roller of claim 1, wherein the internal shaft is fixed relative to the body.

4. The downhole roller of claim 1, wherein a seal is disposed between the wheel and the body.

5. The downhole roller of claim 1, wherein a retaining ring connects the wheel with the body.

6. A method of conveying a tool into a wellbore, the method comprising:

connecting a toolstring with a downhole roller, wherein the downhole roller comprises:

a body having a hinged end opposite a closable pinned end, the pin end configured to receive a pin to prevent the pin end from opening;

a wheel connected with the body;

a bearing assembly disposed between the body and the wheel to allow the wheel to move relative to the body, the bearing assembly including an inner journal bearing and an outer journal bearing;

an internal shaft between the wheel and the bearing assembly and threadably connected to the body, wherein the internal shaft holds the bearing assembly in place; and a lock pin engaged with the internal shaft to prevent the internal shaft from unthreading;

wherein connecting the toolstring with the downhole roller comprises:

opening the pinned end allowing the downhole roller to be placed about the tool string, engaging retaining lips on the body with retaining grooves on the toolstring, closing the pinned end about the toolstring, and inserting the pin in the pinned end to lock the downhole roller about the toolstring; and running the toolstring and downhole roller into the wellbore.

7. The method of claim 6, wherein the bearing assembly comprises an additional inner journal bearing and an additional outer journal bearing.

8. The method of claim 6, wherein the internal shaft is fixed relative to the body.

9. The method of claim 6, wherein a seal is disposed between the wheel and the body.

10. The method of claim 6, wherein a retaining ring connects the wheel with the body.

11. A system for conveying a tool into a wellbore, wherein the system comprises:

a downhole roller comprising:

a body having a hinged end opposite a closable pinned end, the pin end configured to receive a pin to prevent the pin end from opening, and one or more retaining lips disposed on an inner surface of the body;

a wheel connected with the body;

a bearing assembly disposed between the body and the wheel to allow the wheel to move relative to the body, the bearing assembly including an inner journal bearing and an outer journal bearing;

an internal shaft between the wheel and the bearing assembly and threadably connected to the body, wherein the internal shaft holds the bearing assembly in place;

a lock pin engaged with the internal shaft to prevent the internal shaft from unthreading;

a toolstring having one or more retaining grooves formed thereon and at least one downhole tool, the one or more retaining grooves configured to receive the one or more retaining lips; and a conveyance connected with the toolstring.

12. The system of claim 11, wherein the downhole tool is a milling tool, a cutting tool, or a shifting tool.

13. The systems of claim 11, wherein the conveyance is a wireline, cable, or slickline.

14. The system of claim 11, wherein a seal is disposed between the wheel and the body.

15. The system of claim 11, wherein a retaining ring connects the wheel with the body.

* * * * *